US009468342B2

(12) United States Patent
Kelly

(10) Patent No.: US 9,468,342 B2
(45) Date of Patent: Oct. 18, 2016

(54) SAFETY SHOWER CLOSURE

(76) Inventor: Joan G. Kelly, Cherry Hill, NJ (US)

( * ) Notice: Subject to any disclaimer, the term of this patent is extended or adjusted under 35 U.S.C. 154(b) by 791 days.

(21) Appl. No.: 13/196,110

(22) Filed: Aug. 2, 2011

(65) Prior Publication Data

US 2013/0031718 A1 Feb. 7, 2013

(51) Int. Cl.
*A47K 3/38* (2006.01)

(52) U.S. Cl.
CPC ..... *A47K 3/38* (2013.01)

(58) Field of Classification Search
CPC ..... A47K 3/38; A47K 3/34; A47K 3/362; A47K 3/30
USPC ..... 4/605, 607, 608, 609, 558; 160/330, 160/349.1, 349.2, DIG. 6
See application file for complete search history.

(56) References Cited

U.S. PATENT DOCUMENTS

| | | | | | |
|---|---|---|---|---|---|
| 2,668,298 | A | * | 2/1954 | Kimmons | 4/608 |
| 3,322,182 | A | * | 5/1967 | Palella | 160/344 |
| 3,382,507 | A | * | 5/1968 | Micheau | 4/558 |
| 5,097,541 | A | * | 3/1992 | Annand | 4/558 |
| 5,351,739 | A | * | 10/1994 | Levy | 160/124 |
| D441,244 | S | * | 5/2001 | Jerrell et al. | D6/575 |
| D509,089 | S | * | 9/2005 | Titus et al. | D6/575 |
| 2010/0222725 | A1 | | 9/2010 | Munzel | 602/3 |

* cited by examiner

*Primary Examiner* — Erin Deery
(74) *Attorney, Agent, or Firm* — Licata & Tyrell P.C.

(57) ABSTRACT

A shower closure is provided for supporting the weight of a human adult in the event of a fall or to steady a person entering or exiting a shower. The shower closure contains a plurality of handles, straps, cords, rings, or loops extending above the planar surface of the shower closure.

5 Claims, 3 Drawing Sheets

SAFETY SHOWER CLOSURE

BACKGROUND OF THE INVENTION

Shower curtain assemblies are generally used in bathrooms that contain a bathtub or a shower stall. Shower curtain assemblies can include a mounting rod, which extends between the walls on either side of the shower enclosure; a fabric curtain; and a series of rings, which connect the fabric curtain to the mounting rod, and allow the curtain to move freely across the length of the rod. Rods for the shower curtain are conventionally made of lightweight aluminum or chrome-plated steel tubing and the curtain is hung by loops or hooks from the rod. Because the shower curtain is typically made of lightweight plastic sheeting, the rod is not made to be very strong. Sometimes heavier rods or hooks are used when a decorative panel and the water control panel are both suspended from the same rod and their combined weight dictates a sturdier rod.

Modifications, including a handle or a flap, have been made to conventional shower curtains to protect an injured limb from water exposure (see US 2010/0222725). However, these modifications do not address shower safety. Indeed, thousands of people fall in showers and bathtubs every year in the U.S. and have injuries serious enough to warrant medical care. These injuries run from bruises, chipped teeth and bone fractures to death. When a person is falling, reaching out for something to grab onto is instinctive. In this respect, U.S. Pat. No. 5,351,739 discloses a safety net suspended from a shower curtain rod as a structure for someone to grasp during a fall to either slow the fall or stop it before injuries occur.

SUMMARY OF THE INVENTION

The present invention is a shower closure for use with a bathtub or shower said closure having a plurality of grasping means extending above the planar surface of the closure, wherein the grasping means are characterized as weight-bearing elements. In one embodiment, the grasping means are diagonally oriented. In another embodiment, the closure is a component of a system including a shower rod, and in some embodiments carriers for connecting the shower closure to the shower rod.

DETAILED DESCRIPTION OF THE INVENTION

Figure 1A:
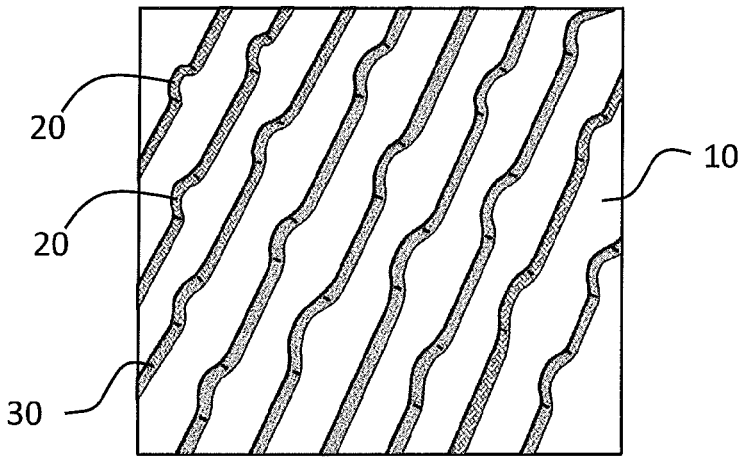
FIG. 1 depicts closure 10 with grasping means 20 as handles created by intermittent attachment of a cord or strap 30 (FIG. 1A), as fabric loops (FIG. 1B), or as rings (FIG. 10) distributed over the surface of closure 10.
FIG. 1D is a top view of closure 10, showing that grasping means 20 extend above the planar surface of closure 10.
Figure 1B:
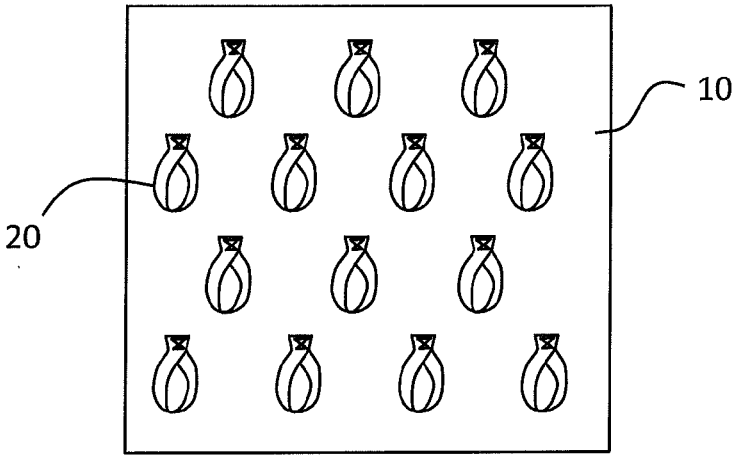
Figure 1C:
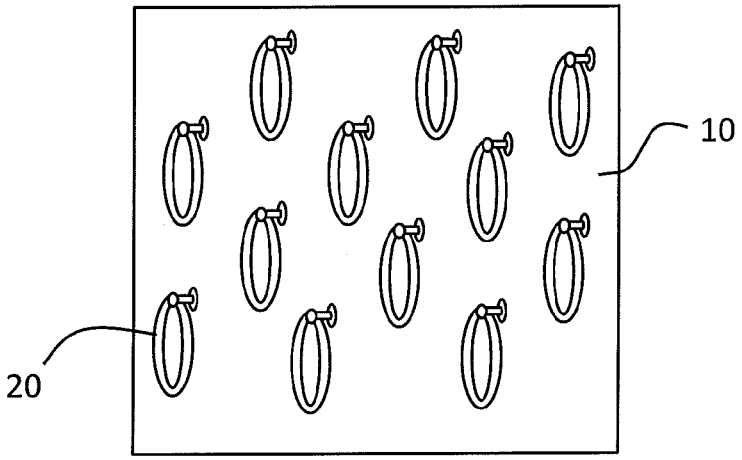
Figure 1D:
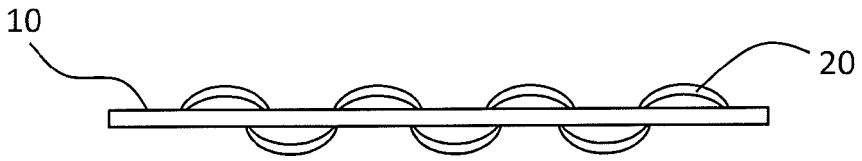

Referring to the drawings, FIG. 1 illustrates shower closure 10 for use in spanning the opening of a shower or bathtub. Shower curtain 10 is made of a flexible and/or foldable material that has a plurality of grasping means 20 extending from and distributed on closure 10 to give a person something to grasp onto to stop or slow a fall. As used herein, plurality refers to more than two. In particular embodiments, plurality refers to more than five, ten, fifteen, or more grasping means 20 distributed on closure 10. In some embodiments, grasping means 20 are presented on the inner surface of shower closure 10, i.e., accessible to a person located in a bath or shower. In other embodiments, grasping means 20 are presented on the outer surface of shower closure 10, i.e., accessible to a person located outside of a bath or shower. In certain embodiments, grasping means 20 are presented on both the inner and outer surfaces of shower closure 10 or accessible from within or outside of a bath or shower.

Closure 10 can be used as a liner along with a traditional shower curtain or can be used alone to enclose a bath or shower stall. In this respect, closure 10 should be as wide as the open side of a shower bath or shower stall. Moreover, closure 10 can be made in a variety of colors, patterns or styles. If the tub is free-standing and the shower curtain encircles it, the closure should also be wide enough to encircle the tub. In particular embodiments, closure 10 is made of a light weight, yet strong material, e.g., parachute fabric, plastic, other suitable material, capable of supporting the weight of an adult human. Alternatively, closure 10 is made of a material sufficiently strong so that it tears slowly enough to retard a fall or reduce the seriousness of an injury. In this respect, the instant grasping means are characterized as "weight-bearing elements" capable of supporting the weight of a subject of 50 kg (110 pounds), 75 kg (165 pounds), 100 kg (220 pounds), or 150 kg (330 pounds) so that said subject does not fall or falls at a reduced rate (as compared to an unsupported fall) thereby reducing injury.

In accordance with the present invention, grasping means 20 extend above or protrude from the planar surface of closure 10 (FIG. 1D) so that a person reaching out during a fall can readily grab grasping means 20. Grasping means 20 can be a handle, strap, cord, ring, or loop integral with or attached to the material of closure 10. Moreover, grasping means 20 can be evenly distributed over the surface of closure 10 or randomly positioned. As illustrated in FIG. 1A, a cord or strap 30 can be attached or affixed (e.g., sewn) to the material of closure 10, such that portions not attached to closure 10 form semispherically-shaped handles, i.e., grasping means 20, that protrude from the surface of closure 10. In an alternative embodiment, fabric loops (FIG. 1B) or plastic or rubber rings (FIG. 1C) can be attached (e.g., sewn or adhered) to a surface of closure 10. Rings molded into closure 10 during manufacture of closure 10 can also serve as suitable grasping means 20.

In particular embodiments, grasping means 20 is formed as illustrated in FIG. 1A by a strap or cord diagonally traversing closure 10 and intermittently attached to closure 10 thereby forming loops or handles extending from the planar surface of closure 10. In accordance with this embodiment, a plurality of cords or straps can traverse closure 10, with the proviso that said plurality of cords or straps do not intersect on another.

To facilitate ease in locating grasping means 20 and preventing children from using grasping means 20 to climb up closure 10, placement of grasping means 20 is on the diagonal of closure 10. In this respect, grasping means 20 are diagonally oriented in the sense that they are positioned such that they are not at right angles to a side of closure 10. See, e.g., FIG. 1A. In addition to preventing children from climbing closure 10, diagonally oriented grasping means 20 will make it easier for tall or short people, who might have long or short arms, or for handicapped persons with contractures or deformities of one or both arms or hands, to readily find a hand-hold in order to facilitate entry to or leaving of the tub or shower. Moreover, in other embodiments, the plurality of grasping means are regularly spaced over the surface of the closure thereby increasing the likelihood that a subject can readily reach one or more grasping means during a fall.

As indicated, either one or both surfaces of closure 10 can be entirely covered by a plurality of grasping means 20 spaced, e.g., about two to 12 inches apart. Preferably, grasping means 20 is made of a material that is not likely to rot, e.g., NYLON, plastic or other synthetic material, and is selected for being capable of supporting the weight of an adult human. Moreover, grasping means 20 can be evenly distributed and at various heights to allow for ease in grabbing grasping means 20.

Figure 2:
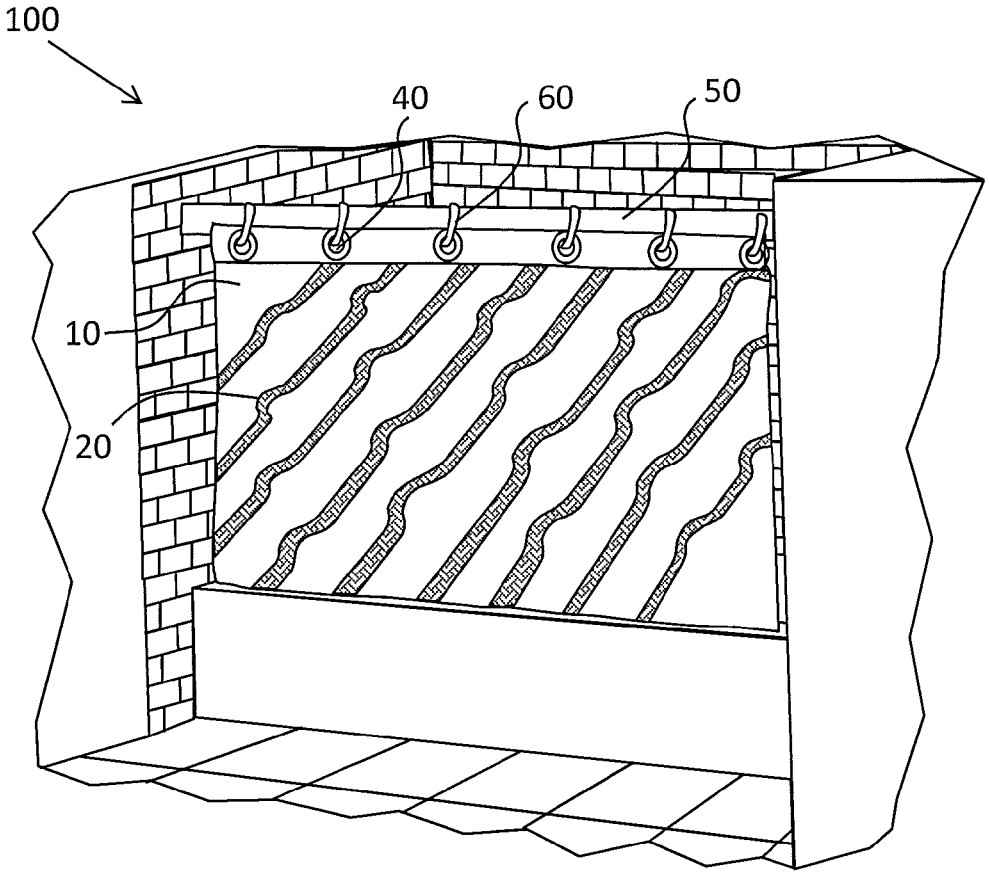
FIG. 2 shows system 100 with closure 10 attached to rod 50 via carriers 60 passing through holes 40 of closure 10.

As shown in FIG. 2, some embodiments embrace closure 10 adapted with holes 40 along one edge, designated the top, so that closure 10 can be suspended from a support rod spanning the opening of a shower or bathtub. In particular embodiments, holes 40 are reinforced, e.g., with grommets to add strength and/or to prevent tearing during a fall.

Figure 3A:
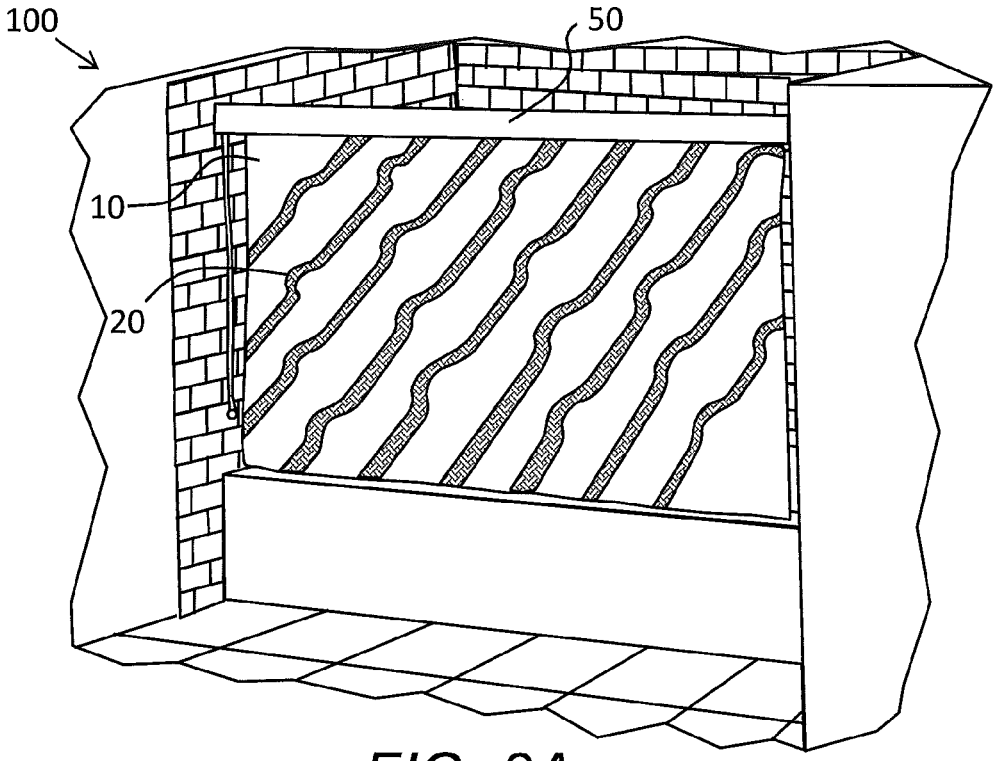
FIG. 3 shows system 100, wherein closure 10 is secured to rod 50 such that closure 10 can be selectively and vertically lowered (FIG. 3A) or raised (FIG. 3B).
Figure 3B:
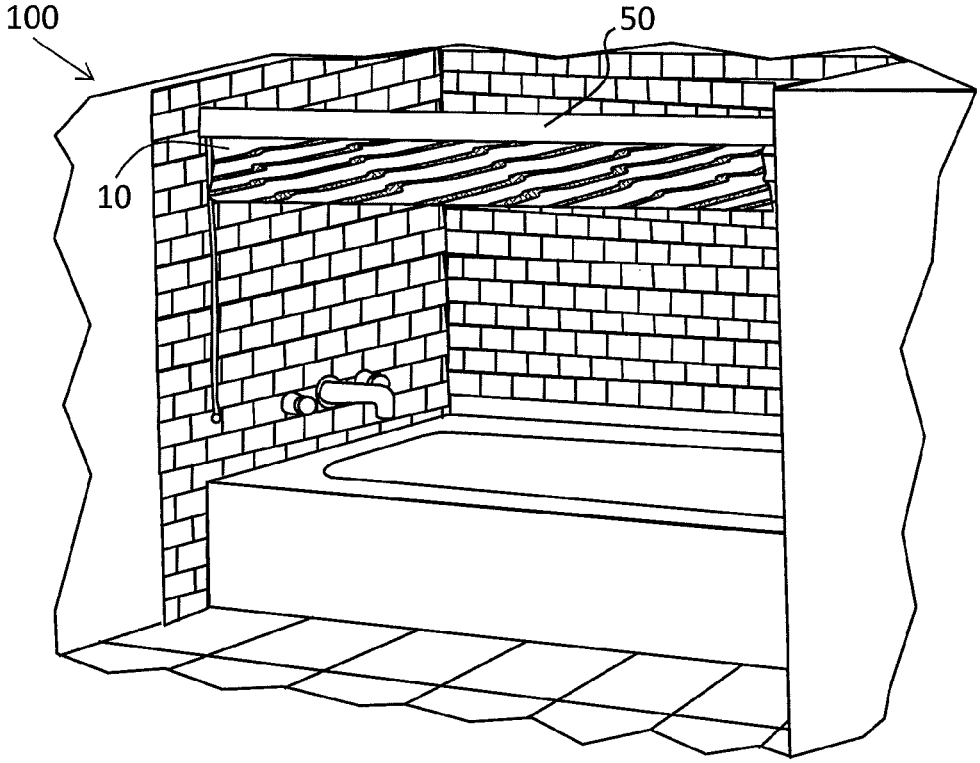

FIGS. 2 and 3 illustrate closure 10 in its environment of use. As illustrated, closure 10 is hung from a strong rod 50 to provide system 100 that stops or slows a fall, or steadies a person when entering or leaving a shower. Shower rod 50 used to support closure 10 is preferably a strong rod, either by virtue of design or material strength or both. For example, one skilled in the art can employ a rod as described in U.S. Pat. No. 5,189,758, incorporated herein by reference. In this respect, rod 50 can have a channel formed in it that serves as a rail for carriers, e.g., rollers, that hold closure 10. Such carriers can extend from the bottom of rod 50 and roll freely from one end to the other.

The term "carriers" is used herein to mean a series of connections between rod 50 and closure 10 that allow closure 10 to be pushed from one end of rod 50 to the other but suspend closure 10 from the rod 50 securely. In this respect, closure 10 slidably hangs from rod 50. Carriers can be made of metal or plastic. As illustrated in FIG. 2, carriers 60 can be rings that encircle rod 50 and pass through holes 40 (e.g., reinforced with grommets). Carriers can be also sturdy hooks.

Alternatively, or in addition to, closure 10 can be affixed or secured to rod 50 and be selectively and vertically raised or lowered with a cord in a manner similar to a window blind. See FIGS. 3A and 3B. In accordance with certain aspects of this embodiment, closure is attached along its length to rod 50 by use of a plurality of conventional and commercially available fasteners (e.g., rivets, thread, or other conventional fasteners). When combined with carriers that allow for closure 10 to be slidably moved, closure 10 can be moved both horizontally and vertically.

The method of installation of the instant closure 10 and system 100 can be carried out by those skilled in the art, wherein the method of installation will vary depending on the support structure available. However, installation techniques that will hold the present rod 50 with closure 10 to a wall are well-known in the art. For example, rod 50 can be fitted through a collar and the collar bolted or screwed into a stud in a wall. Expansion bolts in drywall may also be sufficient.

What is claimed is:

1. A shower closure for use with a bathtub or shower, said shower closure comprising a plurality of grasping means extending from a planar surface of the shower closure, the planar surface including inside and outside surfaces, wherein the grasping means do not intersect and are characterized as weight-bearing elements, each grasping means is individually attached to or integral with the shower closure, and the plurality of grasping means extend from both of the inside and outside surfaces of the shower closure.

2. The shower closure of claim 1, wherein the plurality of grasping means are diagonally oriented with respect to a vertical axis of the shower closure.

3. The shower closure of claim 1, wherein the grasping means are selected from the group of semispherically-shaped handles, straps, cords, rings, and loops.

4. A system for enclosing a bathtub or shower comprising a shower rod and a shower closure with a plurality of grasping means extending from a planar surface of the shower closure, the planar surface including inside and outside surfaces, wherein the grasping means do not intersect, each grasping means is individually attached to or integral with the shower closure, the plurality of grasping means extend from both of the inside and outside surfaces of the shower closure, and said system is capable of supporting the weight of a human adult.

5. The system of claim 4, further comprising carriers for connecting the shower closure to the shower rod.

* * * * *